US008296954B2

(12) United States Patent
Schneider et al.

(10) Patent No.: US 8,296,954 B2
(45) Date of Patent: Oct. 30, 2012

(54) SHAVER HAVING SPACES FOR COLLECTING CUT-OFF HAIRS

(75) Inventors: Ronald Maarten Schneider, Eindhoven (NL); Johannes Cornelius Antonius Muller, Eindhoven (NL); Peter Adrianus Albert Kemps, Schijndel (NL); Jacob Brinkert, Drachten (NL); Geert-Jan Darwinkel, Drachten (NL); Mattheus Jacobus Van Der Meer, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 807 days.

(21) Appl. No.: 12/373,097

(22) PCT Filed: Jul. 9, 2007

(86) PCT No.: PCT/IB2007/052690

§ 371 (c)(1),
(2), (4) Date: Jan. 9, 2009

(87) PCT Pub. No.: WO2008/010139

PCT Pub. Date: Jan. 24, 2008

(65) Prior Publication Data

US 2010/0000092 A1 Jan. 7, 2010

(30) Foreign Application Priority Data

Jul. 14, 2006 (EP) ..... 06117209

(51) Int. Cl.
*B26B 19/14* (2006.01)

(52) U.S. Cl. ..... 30/43.4; 30/43.5; 30/43.6

(58) Field of Classification Search ..... D28/50; 30/43.4–43.6
See application file for complete search history.

(56) References Cited

U.S. PATENT DOCUMENTS

| | | | | |
|---|---|---|---|---|
| 2,787,053 | A | 4/1957 | Kleinman | |
| 3,045,346 | A | 7/1962 | Akerib | |
| 3,069,772 | A | 12/1962 | Roessing | |
| 4,688,329 | A * | 8/1987 | Oord | 30/43.6 |
| 4,847,996 | A | 7/1989 | Blykharov | |
| 6,145,200 | A * | 11/2000 | Jorna et al. | 30/43.6 |
| 6,354,005 | B1 | 3/2002 | Bosch | |

(Continued)

FOREIGN PATENT DOCUMENTS

BE 642751 A 7/1964

(Continued)

OTHER PUBLICATIONS

Sky Mall® Summer 2007, Norelco arcitec Electric Shaver, p. 110.*

*Primary Examiner* — Jason Daniel Prone

(57) ABSTRACT

A shaver includes a shaving unit having e.g., three shaving elements. Each shaving element accommodates a cutter member for cutting off hairs. Each shaving element further accommodates a gear wheel which is part of a transmission for coupling a drive shaft for driving the cutter member to an output shaft of a motor of the shaver. A top side of a space where the gear wheel is located is covered by a partition, where only the drive shaft extends through this partition. Each shaving element can be individually opened by removing a top portion of the shaving element, including the cutter member, from a base portion of the shaving element where the gear wheel, the drive shaft and the partition are located. An opening system may be provided to open all the shaving elements in one action by reversal of the direction of rotation of the output shaft, for example.

17 Claims, 8 Drawing Sheets

U.S. PATENT DOCUMENTS

| | | | | |
|---|---|---|---|---|
| 6,553,668 | B1 * | 4/2003 | Steinberg | 30/43.5 |
| 6,581,289 | B2 * | 6/2003 | Nakano | 30/43.6 |
| 6,671,960 | B2 * | 1/2004 | Kawafune et al. | 30/43.6 |
| 7,020,965 | B2 * | 4/2006 | Bao | 30/43.6 |
| D539,475 | S * | 3/2007 | Dingelstad | D28/50 |
| D539,476 | S * | 3/2007 | Dingelstad | D28/50 |
| D544,999 | S * | 6/2007 | Prat-Pfister | D28/50 |
| D549,873 | S * | 8/2007 | Prat-Pfister | D28/50 |
| D563,599 | S * | 3/2008 | Prat-Pfister | D28/50 |
| 7,401,407 | B2 * | 7/2008 | Miyasaka | 30/43.6 |
| 7,472,483 | B2 * | 1/2009 | Beugels | 30/43.4 |
| 7,530,171 | B2 * | 5/2009 | Baron et al. | 30/43.6 |
| 7,669,336 | B2 * | 3/2010 | Kawafune | 30/43.4 |
| 7,698,819 | B2 * | 4/2010 | De Wit et al. | 30/43.6 |
| 7,930,828 | B2 * | 4/2011 | Brada et al. | 30/43.4 |
| D637,759 | S * | 5/2011 | Byun | D28/50 |
| D651,746 | S * | 1/2012 | Prat-Pfister | D28/50 |
| D654,223 | S * | 2/2012 | Aulwes et al. | D28/50 |
| 2003/0019107 | A1 * | 1/2003 | Visman et al. | 30/43.6 |
| 2004/0078978 | A1 * | 4/2004 | Okabe | 30/43.6 |
| 2004/0237308 | A1 * | 12/2004 | Mitchell et al. | 30/43.6 |
| 2005/0172491 | A1 | 8/2005 | Beugels | |
| 2006/0179657 | A1 * | 8/2006 | Van Der Linden et al. | 30/43.6 |
| 2007/0084059 | A1 * | 4/2007 | Hannan et al. | 30/43.5 |
| 2007/0101575 | A1 * | 5/2007 | Uchiyama | 30/43.6 |
| 2007/0124936 | A1 | 6/2007 | Okabe | |
| 2008/0134513 | A1 * | 6/2008 | Oh | 30/43.6 |
| 2008/0276459 | A1 * | 11/2008 | De Wit et al. | 30/43.6 |
| 2009/0320294 | A1 * | 12/2009 | Shimizu | 30/43.6 |
| 2009/0320295 | A1 * | 12/2009 | Shimizu | 30/43.6 |
| 2010/0011589 | A1 * | 1/2010 | Van Der Borst et al. | 30/43.4 |
| 2011/0067243 | A1 * | 3/2011 | Darwinkel et al. | 30/42 |

FOREIGN PATENT DOCUMENTS

| | | | |
|---|---|---|---|
| GB | 891249 | A | 3/1962 |
| WO | 2006067713 | A1 | 6/2006 |
| WO | WO 2008010139 | A1 * | 1/2008 |
| WO | WO 2008062339 | A1 * | 5/2008 |
| WO | WO 2009147561 | A2 * | 12/2009 |

* cited by examiner

SHAVER HAVING SPACES FOR COLLECTING CUT-OFF HAIRS

FIELD OF THE INVENTION

The present invention relates to a shaver, comprising at least two movably arranged cutter members for cutting off hair; and a shaving unit having shaving elements, wherein each shaving element accommodates a cutter member, and wherein each shaving element comprises a cap which has a plurality of holes for letting through hairs to be shaved off, and a space for receiving cut-off hairs.

BACKGROUND OF THE INVENTION

A shaver as mentioned in the opening paragraph is known from WO/2006/067713. This known shaver comprises a shaving unit having three shaving elements arranged in a triangle formation, wherein in each of the shaving elements, a cutter member is movably arranged. In particular, the cutter member comprises a rotatably arranged disc having a number of cutters, which are arranged on the disc. Furthermore, each of the shaving elements comprises a cap for covering the cutter member, so that direct contact between the skin of a user and the cutter member is prevented. The cap has a plurality of holes for letting through hairs to be shaved off, so that the hairs may be fixed and cut off as a result of a movement of the cutter member.

For the purpose of driving the cutter members, the shaver comprises a motor. Furthermore, the shaver comprises a body portion for accommodating the motor, which is suitable to be held by a user of the shaver. Couplings between the cutter members and the motor are realized through a primary gear wheel which is coupled to an output shaft of the motor, and secondary gear wheels which are in engagement with the primary gear wheel, and which are attached to the cutter members. All gear wheels are located in the shaving unit, not in the body portion, so that only the output shaft of the motor projects from the body portion and needs to be supported by a suitable bearing and seals arranged in an outer housing of the body portion. In case the gear wheels would be located in the body portion, three shafts would project from the body portion, and three bearings and seals would be needed.

In particular, the shaver known from WO/2006/067713 is suitable to be used as a so-called wet shaver, i.e. a shaver which is intended to be used in wet environments, such as a shower. In that case, an additive such as a lotion is used, and cut-off hairs simply exit the shaving unit of the shaver through an open space surrounding the shaft projecting from the body portion, along with the additive. However, it is noted that when the shaver is intended to be used for the purpose of dry shaving, open sides of the shaving elements may be closed by means of small cups or discs, for example, arranged to collect the cut-off hairs and prevent them from flying around during shaving. Such cups or discs are preferably hingedly or otherwise detachably connected to the shaving elements, so as to allow collected hairs to be removed.

SUMMARY OF THE INVENTION

It is an objective of the present invention to provide a shaver as mentioned in the opening paragraph, which is adapted to collect cut-off hairs in another way than the way as proposed in respect of the shaver known from WO/2006/067713. There is a need for such a shaver, as an important disadvantage of the option of closing open sides of the shaving elements by means of small cups or discs is that it is bothersome to a user to try to put relatively small cups or discs to an opened position, especially because these cups or discs are reachable at the side of the body portion.

According to the present invention, in each of the shaving elements of the shaving unit of the shaver, the cutter member is associated with the cap, wherein a whole of the cap and the cutter member is removably arranged with respect to a base portion of the shaving element where the space for receiving cut-off hairs is located. In this way, as the cap of the shaving element is very well reachable, it is achieved that it is very easy for a user of the shaver to open the shaving element.

In the shaver according to the present invention, the hair collecting space may be open to the cutter member, so that this space is readily accessible when the whole of the cap and the cutter member is removed. Moreover, in that case, the hair collecting space is positioned such as to receive cut-off hairs directly from the cutter member, wherein the cut-off hairs do not pass any other component of the shaving element. Consequently, there is no risk of such component getting contaminated by the hairs, or of the hairs hindering the functioning of such element. In the shaver known from WO/2006/067713, in case hair collecting chambers would be added to the shaving elements, the hair collecting chambers would be situated at the side of the shaving elements which is closest to the body portion, and the secondary gear wheel would be between the cutter member and the hair collecting chamber. Hence, when this shaver is operated, the secondary gear wheel gets contaminated by cut-off hairs, as result of which more and more power is needed to turn the gear wheels, and eventually jamming of the gear wheels may occur.

The way in which the cutter member is associated with the cap may be chosen freely, provided that the movements which need to be performed by the cutter member during operation of the shaver are not hindered. For example, a ring-shaped cutter member holder may be attached to a side of the cap where the cutter member is present, wherein dimensions of the cutter member holder are chosen such that the cutter member cannot move beyond the cutter member holder, and wherein the cutter member holder is positioned such that it is impossible for the cutter member to come into contact with the cutter member holder when the cutter member is in a normal operating position. A central open space of the cutter member holder serves for letting through means for coupling the cutter member to a motor or the like for driving the cutter member.

Within the scope of the present invention, it is possible that the whole of the cap and the cutter member is detachably coupled to the base portion of the shaving element. However, it is preferred that the whole of the cap and the cutter member is hingably coupled to the base portion, as in that case, it is easy for a user of the shaver to put the whole of the cap and the cutter member back in place again after having opened the hair collecting space, and there is no risk of losing the whole of the cap and the cutter member.

In a practical embodiment of the shaver according to the present invention, each shaving element accommodates a drive shaft for driving the cutter member, wherein the drive shaft is accommodated in the base portion of the shaving element. Preferably, each shaving element comprises a partition for separating a portion of the shaving element where the cutter member and the space for collecting cut-off hairs are located from another space of the shaving element, wherein the partition is adapted to let through the drive shaft for driving the cutter member.

By providing a partition, the hair-collecting chamber is realized in an advantageous manner, wherein it is possible to start from the design of the shaving unit of the shaver known from WO/2006/067713. It may be necessary to enlarge the shaving elements a little for the purpose of having the partition inside the shaving elements and creating enough space between the partition and the cutter member for receiving cut-off hairs, but the overall appearance of the shaving unit does not need to be significantly changed.

The shaver may comprise a motor for driving the drive shafts for driving the cutter members, and transmission means for coupling the drive shafts to an output shaft of the motor, wherein each shaving element accommodates at least one transmission element, in the space which is separated from the portion of the shaving element where the cutter member and the space for collecting cut-off hairs are located by means of the partition. It is clear that in this case, the partition plays a role in preventing cut-off hairs from reaching the transmission element.

Preferably, in each shaving element, both the transmission element and the partition have a substantially conical shape, in order to have a hair collecting space which is as large as possible within the context of a shaving element having given dimensions. In many cases, it is desirable to have a curved appearance of an outer housing of the shaver element at the side facing the body portion, and it is advantageous if the transmission element and the partition are not simply planar, but are shaped in a different fashion, in order to utilize the space that is present inside the shaving element as efficiently as possible.

As a consequence of the fact that the hair collecting spaces can be opened by removing the cutter member and the cap covering the cutter member, it is not possible to have a fixed connection between the cutter member and the drive shaft. Therefore, in a practical embodiment of the shaver according to the present invention, it is advantageous to have a coupling member in each shaving element, wherein the coupling member is arranged for coupling the cutter member to the drive shaft for driving the cutter member, and wherein the coupling member has a pivoting member for contacting the cutter member and allowing for a pivoting movement of the cutter member with respect to the coupling member. On the basis of the fact that the cutter member is allowed to pivot with respect to the coupling member, it is possible to compensate for alignment errors in the connection between the transmission element and the drive shaft, on the one hand, and the cutter member, on the other.

Other preferred measures for compensating for alignment errors in the connection between the transmission element and the drive shaft, on the one hand, and the cutter member, on the other, involve slidably and rotatably arranging the coupling member with respect to the drive shaft, and connecting the coupling member to resilient means extending through a central hole which is arranged in the drive shaft. These measures may be applied in addition to providing a pivoting member, so that alignment errors may be compensated for without introducing high shearing forces in the cutter member.

In order to facilitate a process of connecting the cutter member to the coupling member, and to realize proper positioning of the cutter member and the coupling member with respect to each other, the coupling member may comprise a number of slanting members, and the cutter member may comprise holes for receiving the slanting members. Naturally, it may also be the other way around. In general, it is preferred that at least one of the cutter member and the coupling member comprises means which are adapted to automatically establish a connection between the cutter member and the coupling member when these members are moved towards each other.

In a practical embodiment of the shaver according to the present invention, the transmission means for coupling the drive shafts for driving the cutter members to the output shaft of the motor comprise gear wheels, wherein, in each shaving element, at least one gear wheel is arranged.

In an advantageous embodiment of the shaver according to the invention, the shaver comprises a movably arranged release element for cooperation with the whole of the cap and the cutter member of each shaving element for making the hair-collecting space of each shaving element accessible.

The above-described and other aspects of the present invention will be apparent from and elucidated with reference to an embodiment of a shaver according to the present invention as described hereinafter.

BRIEF DESCRIPTION OF THE DRAWINGS

The present invention will now be explained in greater detail with reference to the figures, in which equal or similar parts are indicated by identical reference signs, and in which.

DETAILED DESCRIPTION OF AN EMBODIMENT

Figure 1:
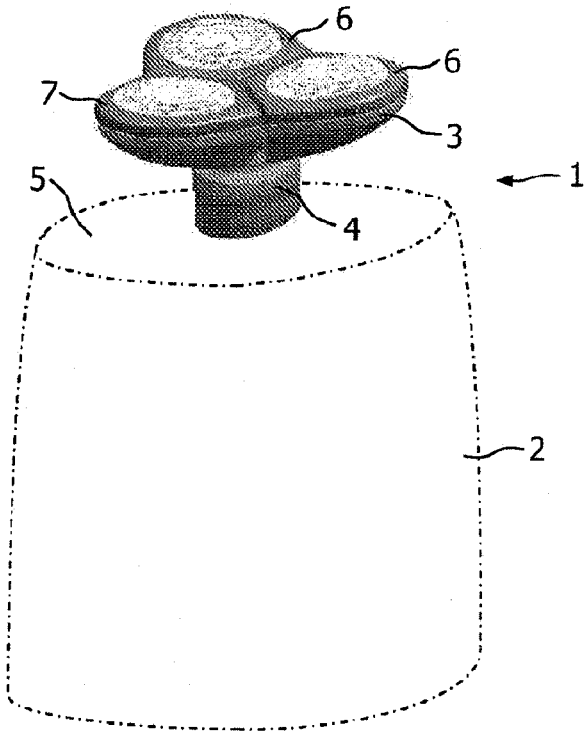
FIG. 1 diagrammatically shows a shaver according to a preferred embodiment of the present invention.

FIG. 1 shows a shaver 1 according to a preferred embodiment of the present invention. The shaver 1 comprises a body portion 2, which is suitable to be held by a user of the shaver. In FIG. 1, for the sake of simplicity, the body portion 2 is only diagrammatically depicted by means of dashed lines, in view of the fact that within the scope of the present invention, the body portion 2 may have any suitable design.

The shaver 1 further comprises a shaving unit 3, which is suitable to contact an area of skin having hairs to be shaved off and to be moved with respect to this area. The shaving unit 3 is connected to the body portion 2 through a central shaft member 4, wherein the connection of the shaving unit 3 to the body portion 2 may be detachable. Cross-sectional dimensions of the central shaft member 4 are considerably smaller than the cross-sectional dimensions of the shaving unit 3, and the shaving unit 3 is positioned at a certain distance from a top portion of an outer housing 5 of the body portion 2. Consequently, the connection between the body portion 2 and the shaving unit 3 has a slim appearance, wherein the shaving unit 3 has an elevated position with respect to the body portion 2. Due to this, when a user performs a shaving action by using the shaver 1, he or she may have a clear side view of the shaving unit 3.

In FIG. 1, the shaver 1 is shown in a typical orientation, namely an orientation in which a side of the shaver 1 where the shaving unit 3 is present is up. In the following, when words like "above" and "under" are used, it is assumed that the shaver 1 is in this orientation. In any case, that does not alter the fact that the shaver 1 may be used in any suitable orientation.

In the example shown, the shaving unit 3 comprises three shaving elements 6, which are arranged in a triangle formation. Within the scope of the present invention, the number of shaving elements 6 may also be two, or more than three. For the sake of completeness, it is noted that each of the shaving elements 6 may be movably arranged to a certain extent, so as to facilitate following a contour of an area of skin to be shaved. For example, the shaving elements 6 may be pivotable with respect to the central shaft member 4, to a limited extent.

Figure 2:
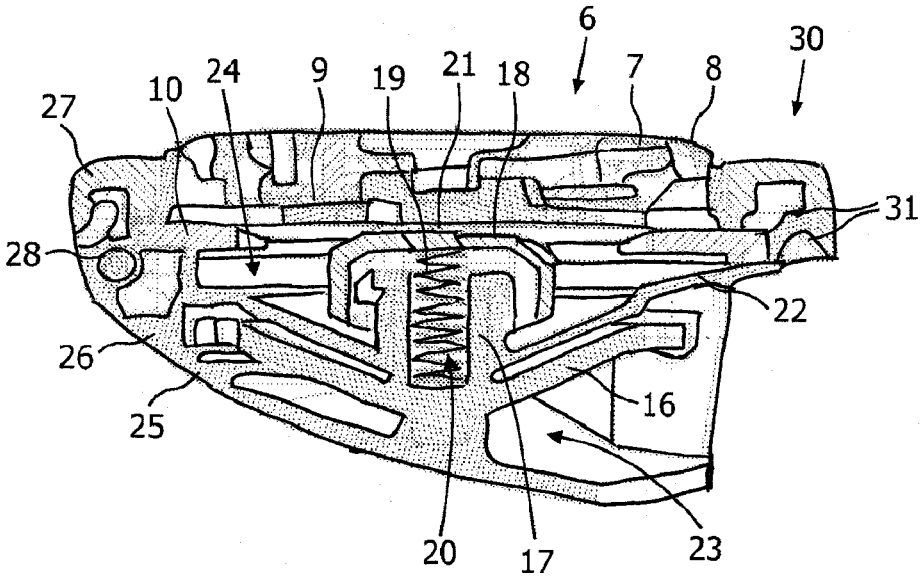
FIG. 2 is a side view of a cross-section through a shaving element of the shaver shown in FIG. 1.

Each shaving element 6 comprises a cap 7, which is arranged at a topside of the shaving element 6, and which has a plurality of holes 8 for letting through hairs to be shaved off. Right underneath the cap 7, on the inside of the shaving element 6, a cutter member 9 is rotatably arranged, as is shown by FIG. 2. During operation, a central portion of the cutter member 9 is pressed against the cap 7. For the purpose of holding the cutter member 9 close to the cap 7 when the cutter member 9 is released, a ring-shaped cutter member holder 10 is attached to the cap 7.

Figure 3:
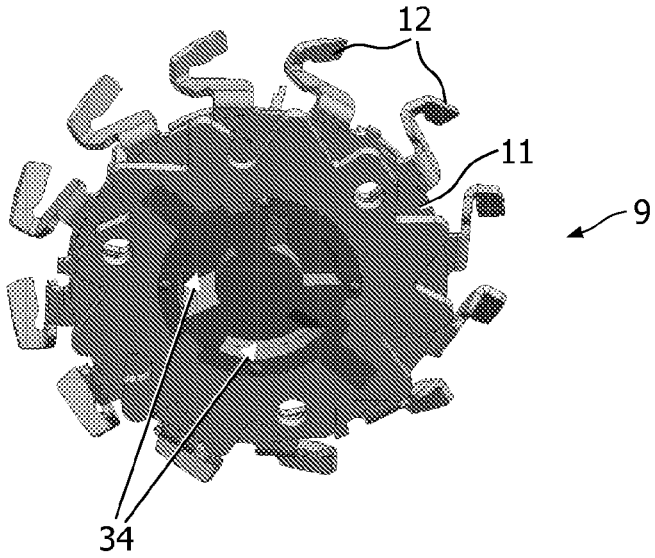
FIG. 3 is a perspective view of a cutter member of the shaver shown in FIG. 1.

In FIG. 3, the cutter member 9 is shown in more detail. In particular, the cutter member 9 comprises a disc 11 and cutters which are arranged on the disc 11, including hook-shaped cutters 12 which are arranged along the circumference of the disc 11. During operation of the shaver 1, the disc 11 is rotated, and hairs extending through the holes 8 in the cap 7 are cut off when they are hit by a cutter 12.

Figure 4:
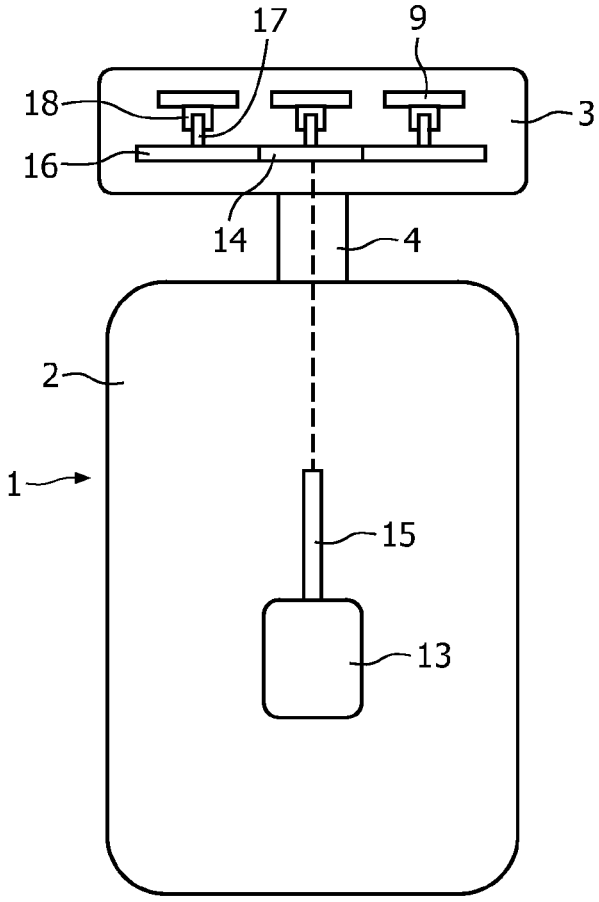
FIG. 4 diagrammatically shows a number of components of the shaver shown in FIG. 1.

For the purpose of driving the cutter members 9, the shaver 1 comprises a number of components, which are diagrammatically shown in FIG. 4, and which will be described in the following. In particular, the shaver 1 comprises a motor 13, which is located in the body portion 2. In the shaving unit 3, at a central position, a gear wheel 14 is arranged, which will hereinafter be referred to as primary gear wheel 14. The primary gear wheel 14 is coupled to an output shaft 15 of the motor 13, in any suitable manner. In FIG. 4, the coupling of the primary gear wheel 14 to the output shaft 15 is diagrammatically depicted by means of a dashed line.

Each shaving element 6 accommodates a gear wheel 16 which is in engagement with the primary gear wheel 14. In the following, the gear wheels 16, which are located inside the shaving element 6, will be referred to as secondary gear wheels 16. A drive shaft 17 for driving the cutter member 9 is extending from each gear wheel 16, and the cutter member 9 is coupled to the drive shaft 17 through a coupling member 18. In the example shown, the coupling member 18 is shaped like a cup, which is placed upside down on a top end of the drive shaft 17.

When the shaver 1 is operated, the motor 13 is in an activated condition, as a result of which the output shaft 15 and the primary gear wheel 14 coupled to the output shaft 15 are rotated about a central rotation axis. As the primary gear wheel 14 is in engagement with the secondary gear wheels 16, the rotation of the primary gear wheel 14 about the central axis of rotation causes rotations of the secondary gear wheels 16 about their respective axes of rotation. Consequently, due to the fact that each cutter member 9 is coupled to a secondary gear wheel 16 through a drive shaft 17 and a coupling member 18, rotations of the cutter members 9 are realized. When a user of the shaver 1 moves the shaving unit 3 across an area of skin, hairs extending through the holes 8 in the caps 7 of the shaving element 6 are cut off by the cutters 12 of the cutter member 9.

In FIG. 2, it is clearly shown that the coupling member 18 which serves for coupling the cutter member 9 to the drive shaft 17 is connected to a coil spring 19 extending through a central hole 20 which is arranged in the drive shaft 17. Under the influence of the coil spring 19, the coupling member 18 is pressed against the cutter member 9. Furthermore, on the basis of this connection between the drive shaft 17 and the coupling member 18, alignment errors of the cutter member 9 to the drive shaft 17 and the secondary gear wheel 16 are compensated for. Additionally, at a topside, the coupling member 18 is provided with a pivoting member 21 for contacting the cutter member 9 and allowing the cutter member 9 to pivot with respect to the coupling member 18.

In each shaving element 6, right above the secondary gear wheel 16, a partition 22 is arranged, which closes a top side of a space 23 in the shaving element 6 where the secondary gear wheel 16 is present, wherein only the drive shaft 17 is extending through the partition 22. Another space 24 in the shaving element 6, which is present between the partition 22 and the cutter member 9, serves as a hair collecting space, i.e. a space where cut-off hairs are received and stored. The partition 22 serves as a bottom of the hair collecting space 24.

In order to have a hair collecting space 24 which is as large as possible within a given shape and given dimensions of the shaving element 6, the secondary gear wheel 16 has a conical shape, so that the partition 22 may also have a conical shape. In this respect, it is noted that a bottom portion of an outer housing 25 of the shaving element 6 has a curved appearance, so that the shaving unit 3 as a whole has an appealing appearance with smooth and round shapes. If the secondary gear wheel 16 and the partition 22 would be planar, the width and/or height dimensions of the shaving element 6 would need to be larger, and/or the shape of the bottom portion of the outer housing 25 of the shaving element 6 would need to be different in order to have a hair collecting space 24 which is as large as the hair collecting space 24 having the conical bottom 22.

Figure 6:
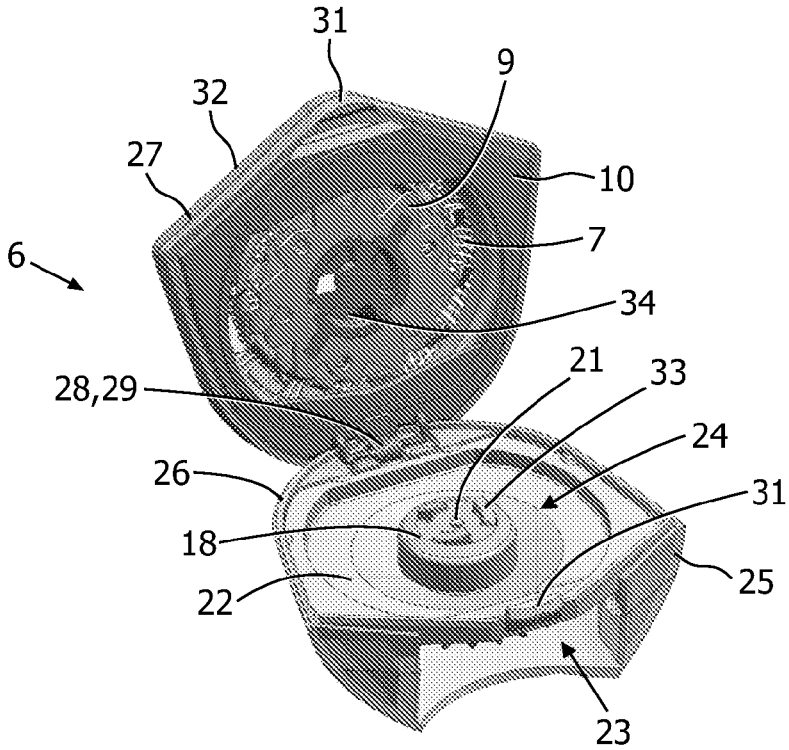
FIG. 6 is a perspective view of a shaving element of the shaver shown in FIG. 1, wherein a hair collecting space is opened.

In each shaving element 6, for the purpose of opening and emptying the hair collecting space 24, a whole of the cap 7, the cutter member 9 and the cutter member holder 10 is hingably coupled to a base portion 26 of the shaving element 6 where the secondary gear wheel 16, the drive shaft 17, the coupling member 18 and the partition 22 are located. In the following, for the sake of clarity, the whole of the cap 7, the cutter member 9 and the cutter member holder 10 will be referred to as top portion 27 of the shaving element 6. Within the scope of the present invention, any suitable type of hinge 28 may be applied. For example, the hinge 28 may comprise a torsion spring 29 as shown in FIG. 6 or another suitable type of spring. It is also possible that a connection of the top portion 27 to the base portion 26 of the shaving element 6 is established through other means, for example a ribbon or a slide.

Figure 5:
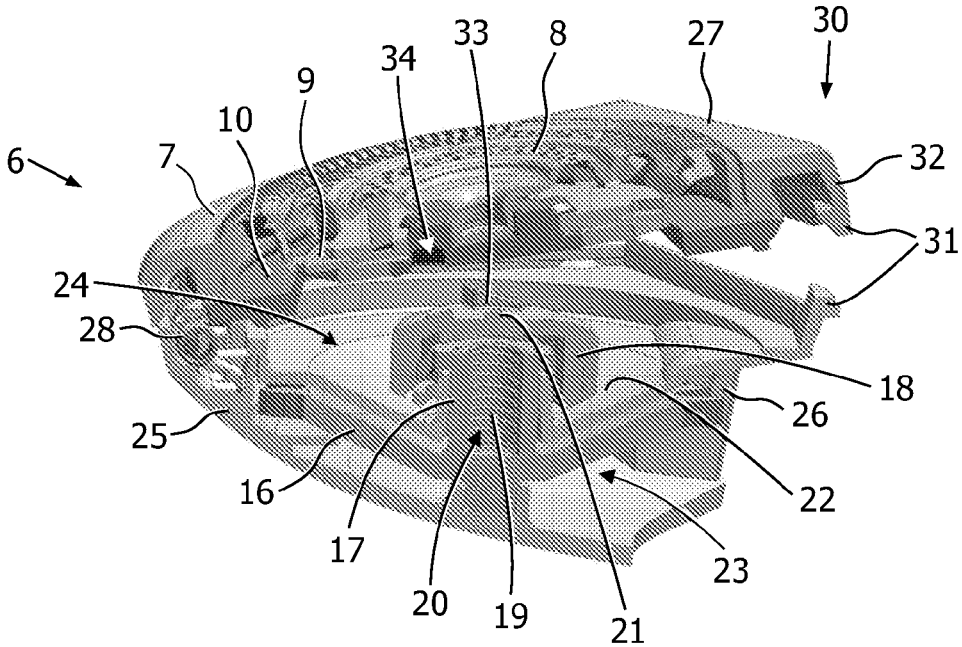
FIG. 5 is a perspective view of a cross-section through a shaving element of the shaver shown in FIG. 1, wherein a process of opening a hair collecting space of the shaving element is illustrated.

FIG. 5 illustrates a position of the top portion 27 with respect to the base portion 26 of the shaving element 6 which is between a completely opened position and a completely closed position. FIG. 6 illustrates the completely opened position. In this position, the hair collecting space 24 is freely accessible, so that hairs may be removed, and a cleaning action may be performed, if so desired. Furthermore, in this position, the cutter member 9 may be inspected and cleaned, if so desired.

For the purpose of keeping the top portion 27 in a closed position with respect to the base portion 26 during normal operation of the shaver 1, a locking mechanism 30 is provided. In the example shown, both the top portion 27 and the base portion 26 comprise hook-shaped locking members 31, which are in engagement with each other in the closed position of the top portion 27 with respect to the base position 26. Under the influence of force exerted by a user of the shaver 1, wherein the user may take hold of a rim 32 of the top portion 27 with a thumb and a finger, for example, a release of the locking member 31 associated with the top portion 27 from the locking member 31 associated with the base portion 26 may be realized, so that the top portion 27 may be put in the completely opened position with respect to the base portion 26.

It is easy for a user to open the hair collecting spaces 24, namely by taking hold of the rim 32 of the top portion 27, and causing a release of the locking member 31 associated with the top portion 27 from the locking member 31 associated with the base portion 26. At the moment the release takes place, the top portion 27 is moved to the completely opened position with respect to the base portion 26 by means of the torsion spring 29, and is kept in this position until the user moves the top portion 27 back to the closed position with respect to the base portion 26 again.

Figure 7:
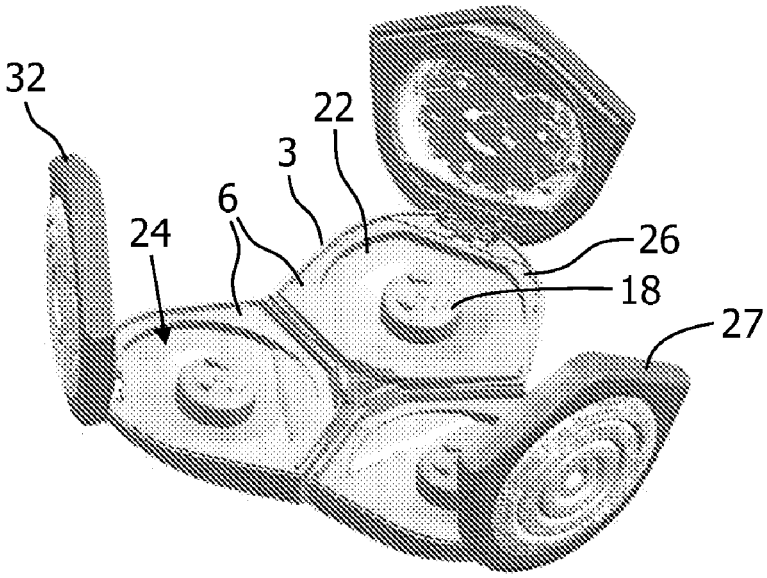
FIG. 7 is a perspective view of a shaving unit of the shaver shown in FIG. 1, wherein hair-collecting spaces of all shaving elements are opened.

Preferably, the locking members 31 are situated near a center of the shaving unit 3, whereas the hinge 28 is situated opposite the locking members 30. In that case, the hinge 28 is situated at an outer circumference of the shaving unit 3. Consequently, the hair collecting spaces 24 of all shaving elements 6 may be opened, without the top portion 27 of one of the shaving elements 6 colliding with the top portion 27 of another one of the shaving elements 6. Furthermore, an aesthetic advantage is obtained, as the configuration of the shaving unit 3 having the top portions 27 of the shaving elements 6 in the opened position with respect to the base portions 26 resembles the appearance of an opened flower, as is shown in FIG. 7, which is very appealing to a user of the shaver 1.

At a topside, the coupling member 18 comprises a number of slanting projections 33, and the cutter member 9 comprises a number of holes 34 for receiving these projections 33. When the top portion 27 of the shaving element 6 is in the completely closed position with respect to the base portion 26, the projections 33 are accommodated inside the holes 34, so that, due to the fact that the coupling member 18 is pressed against the cutter member 9 under the influence of the coil spring 19, the cutter member 9 is forced to rotate when the coupling member 18 is rotated. When the top portion 27 of the shaving element 6 is in an opened position with respect to the base portion 26, the connection between the coupling member 18 and the cutter member 9 through the projections 33 is lost. When the top portion 27 is moved back to the closed position with respect to the base portion 26 again, the slanting projections 33 contact a bottom side of the cutter member 9 first, and, during the movement of the top portion 27, the coupling member 18 and the cutter member 9 are rotated with respect to each other under the influence of the slanting shape of the projections 33, until the projections 33 snap into the holes 34.

Figure 8:
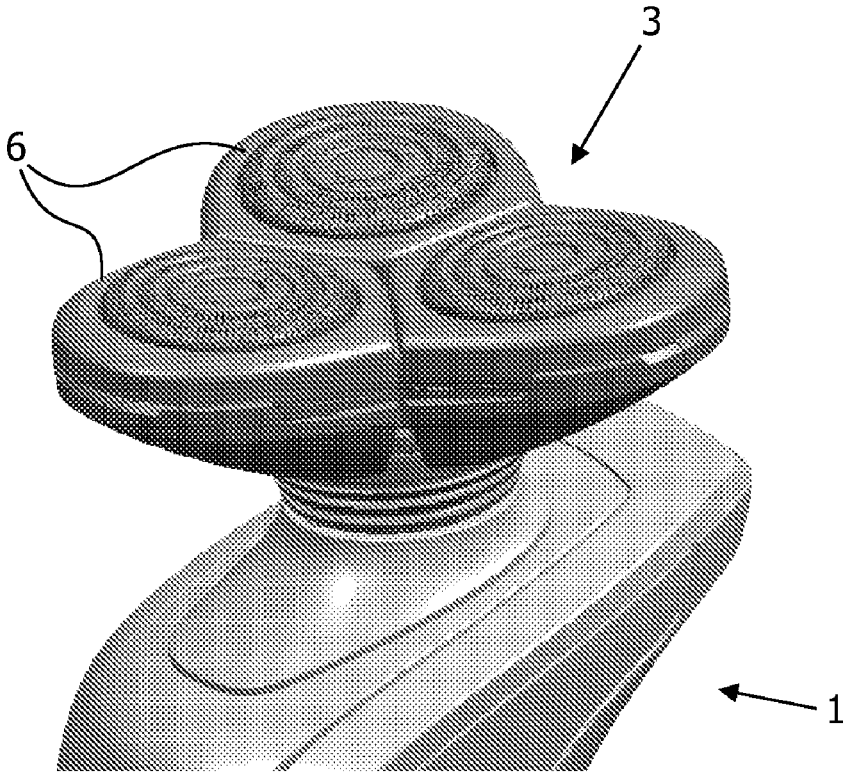
FIG. 8 is a perspective view of a shaver.

An opening system to conveniently open the hair-collecting spaces 24 will be described here below. In FIG. 8 a shaver 1 is shown having its shaving elements 6 in a position, wherein the spaces 24 for receiving cut-off hairs are closed. To conveniently open the three shaving elements 6 in a single action, the shaver 1 is provided with an opening system as enclosed with reference to FIGS. 9 to 12.

Figure 9:
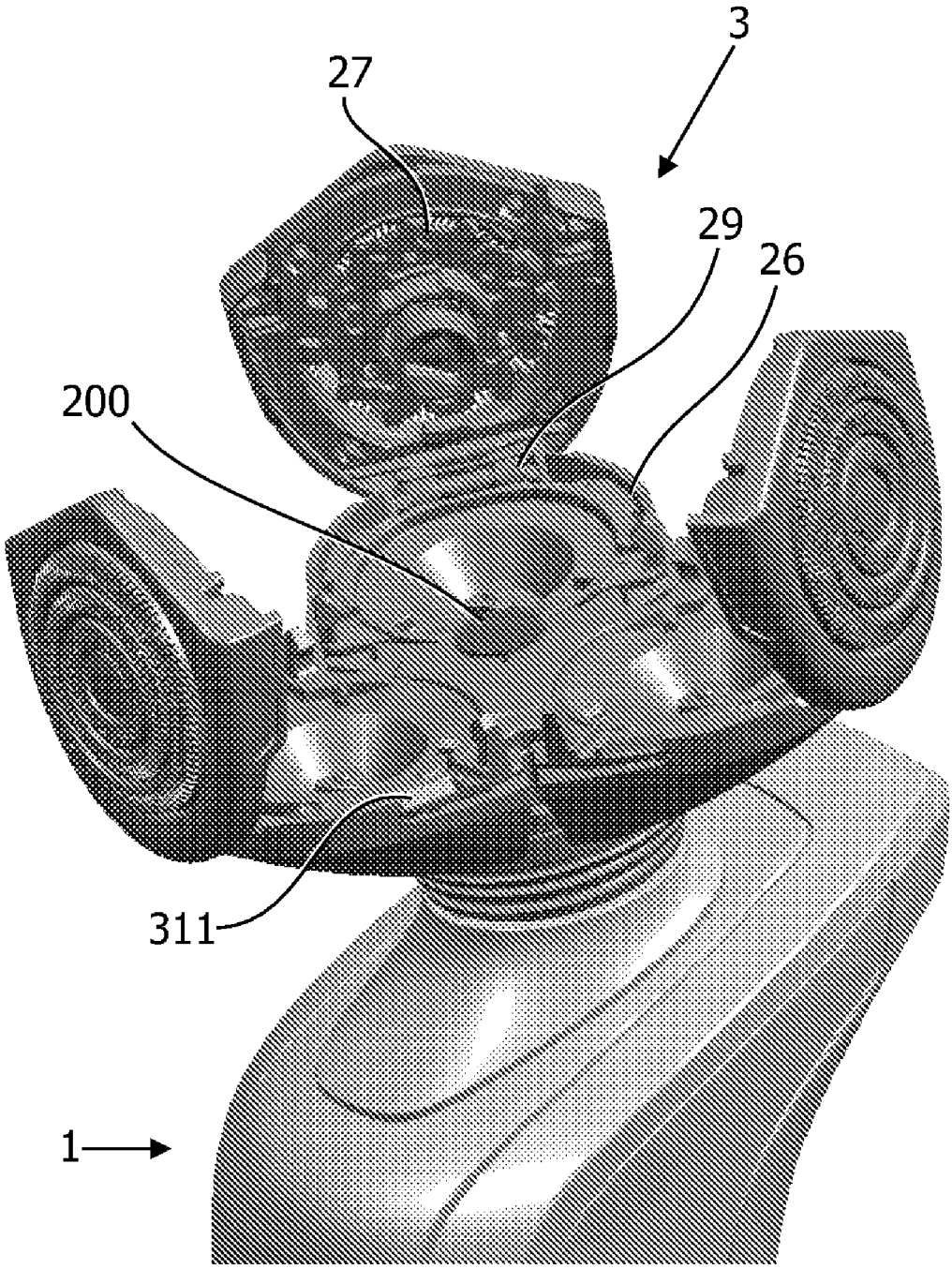
FIG. 9 is a perspective view of the shaver shown in FIG. 8, wherein the hair-collecting spaces are opened.

In FIG. 9 a portion of the shaver of FIG. 8 is depicted. The shaving elements 6 are in a position wherein the spaces 24 for receiving cut-off hairs are opened. A longitudinal release element 200, as part of the opening system to open the three shaving elements 6 in a single action, is positioned between base portions 26 of the shaving elements 6. The release element 200 is covered by the caps and cutters of the three shaving elements 6, when the shaving elements 6 are in their shaving position (FIG. 8). Each top portion or whole 27 of cap and cutter member of each shaving element 6 is hingably connected to its respective base portion 26. At the moment the release takes place, the top portion 27 is moved to a completely opened position with respect to the base portion 26 by means of a torsion spring 29, and is kept in this position until the user moves the top portion 27 back to the closed position with respect to the base portion 26 again as described here above. The release is caused by a translation of the release member 200. During translation the release member 200 pushes the top portions 27 through the resistance of locking members 311 (FIG. 10*a*) near the sides of the triangular shaving unit 3.

Figure 10B:
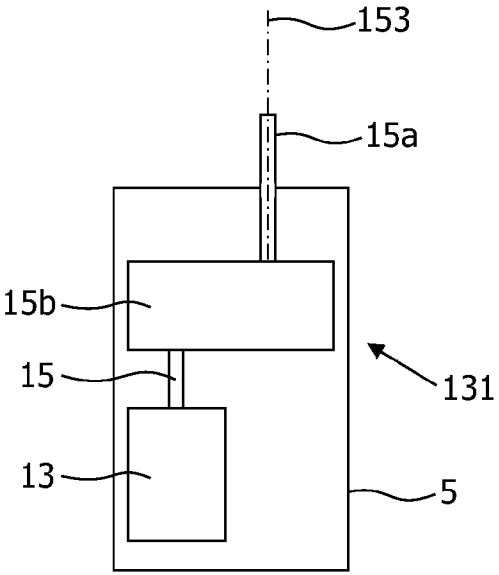
FIG. 10*b* schematically depicts a further portion of the shaver of FIG. 8.
Figure 10A:
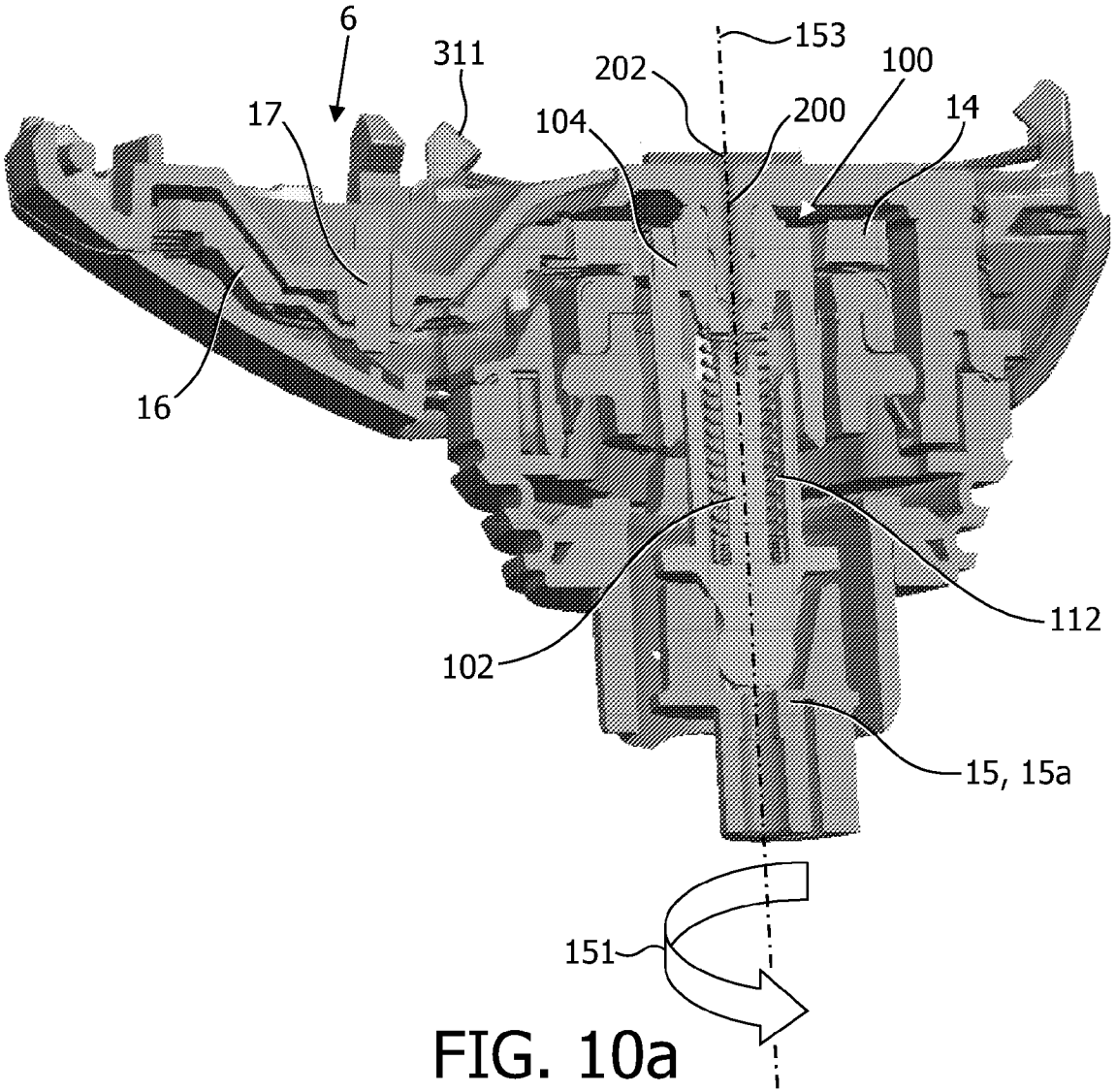
FIG. 10*a* is a perspective view of a cross-section through a portion of the shaver of FIG. 8.

In FIG. 10*a* a perspective view of a cross-section through a portion of a shaver of FIG. 8 is depicted. Drive shafts 17 are drivable by a motor unit 131 (schematically depicted in FIG. 10*b*). The motor unit 131 is accommodated in a housing 5 of the shaver. The motor unit 131 comprises a motor 13 coupled to transmission means 15*b*. Various configurations of the transmission means 15*b* are conceivable. The transmission means 15*b* may comprise a gear box for adaptation of the rotational speed of an output shaft 15*a* of the motor unit 131 to the rotational speed of an output shaft 15 of the motor 13. The transmission means 15*b* may comprise an extra inter-shiftable gear for reversal of a clockwise direction of rotation of the output shaft 15 of the motor 13 into an anti-clockwise direction of rotation of the output shaft 15*a* of the motor unit 13 for purposes as described here below. The transmission means 15*b* may comprise a single shaft in which case the output shaft 15 of the motor is the output shaft 15*a* of the motor unit 131. In the portion of the shaver as depicted in FIG. 10*a*, a transmission device 100 driveably couples the drive shafts 17 to an output shaft 15*a* of the motor unit 131 via a primary gear 14 (FIG. 4) of a central gear member 104 as already described. The transmission device 100 comprises an engagement member 102, a coil spring 112, a central gear member 104 and three secondary gears 16. Each shaving unit 6 has one secondary gear 16 driveably coupled to its drive shaft 17. The engagement member 102 is axially slideable with respect to the central gear member 104 along an axis 153. Axis 153 is an axis of rotation of the central gear member 104, the engagement member 102 and output shaft 15*a*. The engagement member 102 is positioned between the output shaft 15*a* and the central gear member 104. During normal operation, i.e. during shaving, the direction of rotation of the output shaft 15*a* around an axis of rotation 153 is as indicated by arrow 151. The engagement member 102 and the central gear member 104 are pretensioned by the coil spring 112 acting between the engagement member 102 and the central gear member 104. Contrary to the engagement member 102, the central gear member 104 is not slideable along its axis of rotation 153. The coil spring 112 pushes the engagement member 102 towards the output shaft 15*a* of the motor unit 131, i.e. away from the central gear member 104. The release member 200 is secured to the engagement member 102, e.g. by a press-fit, and slideable along axis 153 with respect to the central gear member 104. Being secured to the engagement member 102, the release member 200 follows the engagement member 102. In the situation as depicted in FIG. 10*a*, i.e. corresponding to normal operation, the release element 200 and the engagement element 102 are close to the output shaft 15*a*. A top portion 202 of the release element 200 contacts the base portions of the shaving elements to allow for and to enable complete closure of the spaces 24 for the cut-off hairs by the top portions 27 of each shaving element 6.

Figures 11A, 11B:
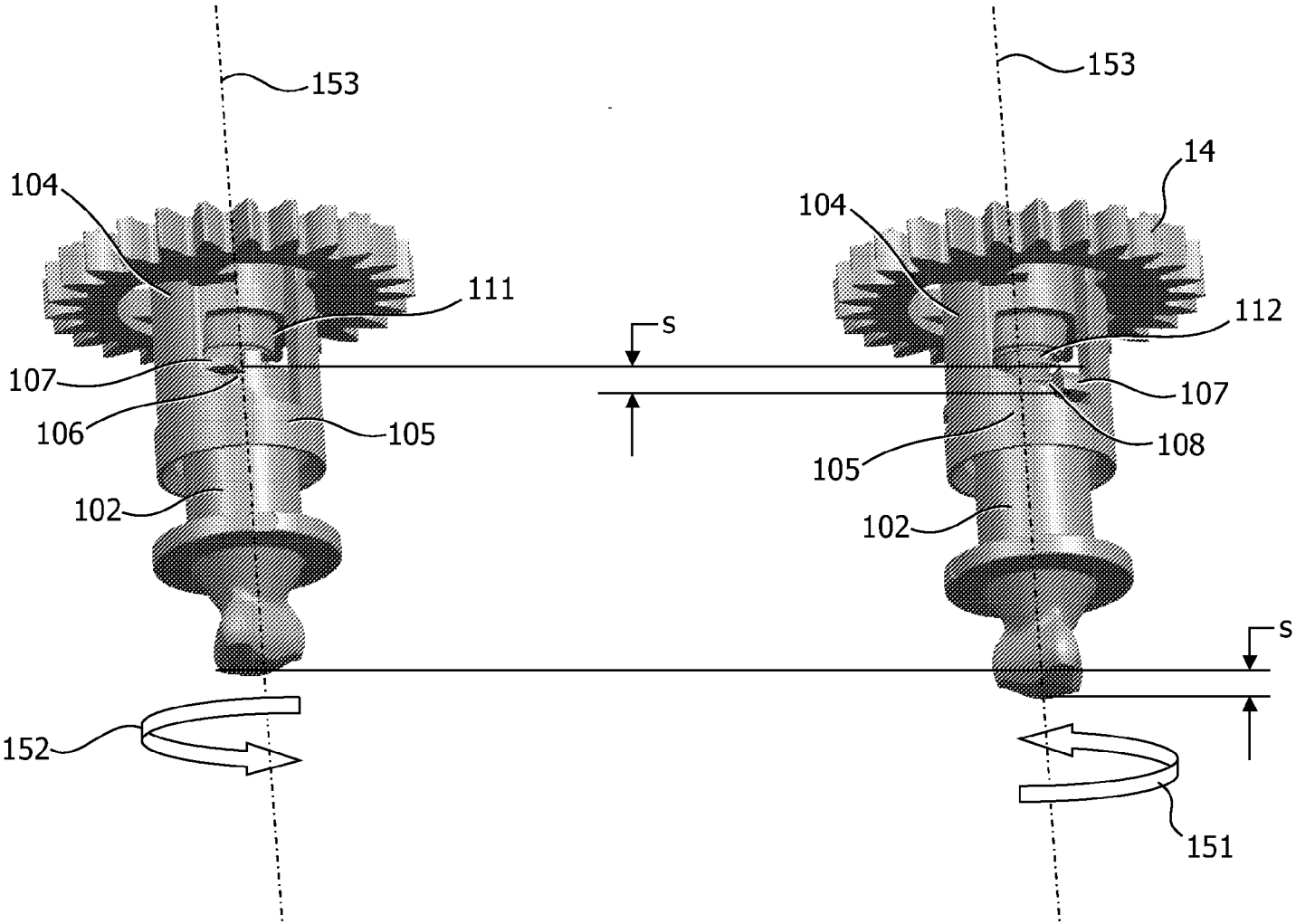
FIGS. 11*a* and 11*b* are perspective views of a detail of FIG. 8.

In FIGS. 11*a* and 11*b* the central gear member 104 and the engagement member 102 of the transmission device 100 of FIG. 10*a* are shown in more detail. FIG. 11*b* corresponds to normal mode of operation as explained according to FIG. 10*a*, e.g. during shaving. The direction of rotation around the axis of rotation 153 and corresponding to the normal mode of operation is indicated by arrow 151. The engagement member 102 is driveably coupled to the output shaft 15*a* of the motor unit 131 (FIG. 10*b*). The direction of rotation of the engagement member 102 corresponds to the direction of rotation of the output shaft 15*a*. By reversing the rotation direction of the output shaft 15*a*, the engagement member 102 reverses its direction of rotation also as depicted in FIG. 11*a*. The reversed direction of rotation around axis of rotation 153 is indicated by an arrow 152. The engagement member 102 has a protrusion 107, positioned in a recess opening 111 of an engagement portion 105 of the central gear member 104. During changing of the rotation direction, the engagement member 102 performs a translation s along the axis of rotation 153 with respect to the central gear member 104, the protrusion 107 being guided by a slanting face 106 of the recess opening 111. The force exerted by the coil spring 112 secures the contact between the protrusion 107 of the engagement member 102 and the slanting face of the engagement portion 105 of the central gear member 104. Means for reversal of the direction of rotation are generally known by the person skilled in the art, e.g. by reversing the polarity of the motor or by use of an extra (reversing) gear and transmission means 15*b* (FIG. 10*b*). The displacement of the engagement member 102 relative to the output axis 15*a* and the central gear member 104 may be realized by a threaded portion of the engagement member 102 cooperating with a corresponding surface of a part of the central gear member 104 or by a protrusion of the engagement portion 105 of the central gear member 104 extending through a recess opening of the engagement member, i.e. by inversion of the coupling between the engagement member 102 and the central gear member 104 as indicated in FIGS. 11*a* and 11*b*.

Figures 12A, 12B:
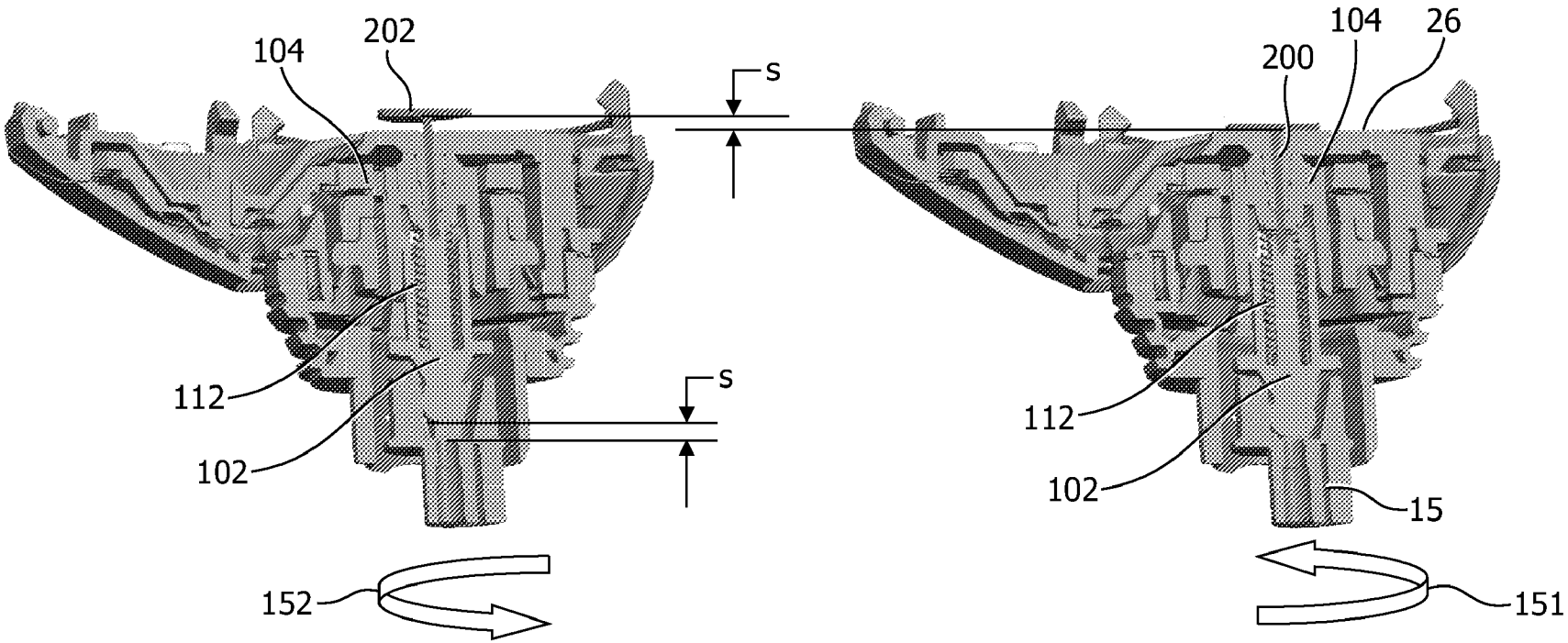
FIGS. 12*a* and 12*b* are perspective views of a cross-section through a portion of the shaver of FIG. 8.

In FIGS. 12*a* and 12*b* the central gear member 104 and the engagement member 102 of the transmission device 100 of FIGS. 10 and 11 are depicted. The clockwise and counterclockwise directions of rotation are indicated by arrows 152 and 151 in FIGS. 12*a* and 12*b* respectively. In FIG. 12*b* the engagement member 102 and the release member 200 are in a position close to the output shaft 15. After reversal of the direction of rotation of the output shaft 15 as indicated by arrow 152 in FIG. 12*a*, the engagement member 102 is forced away from the output shaft 15 against the force that is exerted by coil spring 112. The release member or push pin 200 is coupled to the engagement member 102 and follows the displacement of the engagement member 102. The top portion 202 is pushed away from the base portions 26 (FIG. 12*b*) over the same distance s as explained according to FIG. 11.

It will be clear to a person skilled in the art that the scope of the present invention is not limited to the examples discussed in the foregoing, but that several amendments and modifications thereof are possible without deviating from the scope of the present invention as defined in the attached claims. While the present invention has been illustrated and described in detail in the figures and the description, such illustration and description are to be considered illustrative or exemplary only, and not restrictive. The present invention is not limited to the disclosed embodiments.

For example, the locking mechanism 30 for locking the top portion 27 of the shaving element 6 to the base portion 26 when the top portion 27 is in the completely closed position with respect to the base portion 26 may be any suitable locking mechanism 30, and does not necessarily need to comprise the hook-shaped locking members 31 as shown. Furthermore, depending on the type of locking mechanism 30, there may be various ways of releasing the lock. There may even be a button or the like which needs to be depressed by a user of the shaver 1 in order to release the top portion 27 of the shaving element 6.

For example, the invention is also applicable to shaver having one movably arranged cap 7. In such case the shaver comprises a movably arranged release element 200 for cooperation with the cap or with the whole 27 of the cap and the cutter element 9 for making a space 24 for receiving cut-off hairs accessible.

The way in which a connection between the coupling member 18 and the cutter member 9 is realized may be different than by using the slanting projections 33 and the holes 34 as shown. In the first place, the projections 33 may be arranged on the cutter member 9, and the holes 34 may be arranged in the coupling member 18. In the second place, completely different means may be applied, wherein it is preferred if the connection between the coupling member 18 and the cutter member 9 is easily broken and established. Most preferably, the connection is automatically broken when the top portion 27 of the shaving element 6 is moved away from the base portion 26, and the connection is automatically established when the top portion 27 is moved towards the base portion 26.

Other variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the present invention.

In the foregoing, a shaver 1 having a body portion 2 and a shaving unit 3 is disclosed. The shaving unit 3 comprises a number of shaving elements 6, wherein each shaving element 6 accommodates a cutter member 9 for cutting off hairs, and has a cap 7 which serves for covering the cutter member 9, and which has holes 8 for letting through the hairs. Each shaving element 6 further accommodates a gear wheel 16 which is part of transmission means for coupling a drive shaft 17 for driving the cutter member 9 to an output shaft 15 of a motor 13 of the shaver 1 in order to obtain a movement of the cutter member 9 when the motor 13 is operated.

A top side of a space 23 where the gear wheel 16 is located is covered by a partition 22, wherein only the drive shaft 17, which is projecting from a central portion of the gear wheel 16, is extending through this partition 22. In this way, it is achieved that cut-off hairs cannot reach the gear wheel 16, while it is still possible to drive the cutter member 9. Furthermore, it is achieved that the design of the shaving element 6 does not significantly need to be adapted in order to have a hair collecting space 24 in the shaving element 6.

The hair collecting space 24 can easily be opened by removing a top portion 27 of the shaving element 6, which comprises the cap 7, the cutter member 9 and a cutter member holder 10 from a base portion 26 of the shaving element 6 where the gear wheel 16, the drive shaft 17 and the partition 22 are located. Preferably, to this end, the top portion 27 is hingably attached to the base portion 26.

The invention claimed is:

1. A shaver comprising: a shaving unit having a plurality of shaving elements, wherein each of the shaving elements incorporates a base portion defining a space for receiving cut-off hairs and a cap having a cutter member configured to receive and cut hair, and wherein each of the caps is independently movable with respect to the other caps between an open position that exposes a respective one of the base portion spaces and a closed working position.

2. The shaver according to claim 1, wherein each of the caps is hingedly coupled to a respective one of the base portions allowing for the independent cap movement.

3. The shaver according to claim 2, wherein each of the hinged couplings comprises a hinge located at an outer side of the respective one of the base portions.

4. The shaver according to claim 3, wherein each of the hinges further comprises a torsion spring that biases a respective one of the caps toward the open position.

5. The shaver according to claim 1, wherein each of the shaving elements incorporates a drive shaft for driving a respective one of the cutter members, and wherein each of the drive shafts is accommodated in a respective one of the base portions.

6. The shaver according to claim 5, wherein each of the shaving elements incorporates a partition for separating a portion of each of the shaving elements that has the cutter member and the base portion space from a second space, wherein each of the partitions has a hole that receives a respective one of the drive shafts.

7. The shaver according to claim 6, further comprising a motor with an output shaft for driving the drive shafts and a transmission having gear wheels between the drive shafts; wherein each of the shaving elements accommodates a respective one of the gear wheels in the second space.

8. The shaver according to claim 7, wherein the gears wheels and the partitions all have a substantially conical shape.

9. The shaver according to claim 5, wherein each of the shaving elements incorporates a coupling member for coupling a respective one of the cutter members to a respective one of the drive shafts, and wherein each of the coupling members has a pivoting member for contacting the respective one of the cutter members to allow the respective one of the cutter members to pivot with respect to a respective one of the coupling members.

10. The shaver according to claim 9, wherein each of the drive shafts incorporates a central hole, each one of the central holes having a resilient device extending therethrough, and each one of the resilient devices is connected to a respective one of the coupling members.

11. The shaver according to claim 9, wherein at least one of the cutter members and a respective one of the coupling members comprise a means for automatically establishing a connection between the at least one of the cutter members and the respective one of the coupling members when a respective one of the caps is moved from the open position to the closed position.

12. The shaver according to claim 9, wherein each of the coupling members comprise at least one slanted member and each of the cutter members comprise at least one hole for receiving the at least one slanted member.

13. The shaver according to claim 1, further comprising a release element, wherein the release element releases the caps thereby allowing the caps to move from the closed position to the open position.

14. The shaver according to claim 13, wherein the release element is a pushing release element.

15. The shaver according to claim 14, wherein the plurality of shaving elements comprise three shaving elements arranged in a triangle formation, wherein the pushing release element is located in a central portion of the triangle formation and releases the three shaving elements simultaneously.

16. The shaver according to claim 13, further comprising a motor with an output shaft for driving the cutter members, a transmission device for coupling the cutter members to the output shaft, wherein the output shaft and the cutter members are drivable by the motor in a first direction of rotation, wherein the release element engages an engagement member of the transmission device in a second direction of rotation opposite the first direction of rotation.

17. The shaver according to claim 16, wherein the transmission device has a central gear member with a first face, wherein the engagement member has a second face and is slideably coupled to the output shaft and the central gear member, the output shaft has third face, wherein the second face cooperates with the first face or the third face during the second direction of rotation, wherein at least one of the first face, second face, and third face is a slanted face.

* * * * *